US005386396A

United States Patent [19]

Deltour et al.

[11] Patent Number: 5,386,396

[45] Date of Patent: Jan. 31, 1995

[54] PROCESS FOR PRODUCING THE OUTPUT SURFACE OF A FOCUSED ULTRASONIC BEAM TRANSDUCER AND TRANSDUCER WITH AN OUTPUT SURFACE PRODUCED BY SAID PROCESS

[75] Inventors: Damien Deltour, Essertenne; Pascal Dumont, Chatenoy Le Royal, both of France

[73] Assignees: Framatome; Compagnie Europeene Du Zirconium dite Cezus, Courbevoie, France

[21] Appl. No.: 120,382

[22] Filed: Sep. 14, 1993

[30] Foreign Application Priority Data

Sep. 14, 1992 [FR] France ..... 92 10915

[51] Int. Cl.[6] ..... H04R 1/20

[52] U.S. Cl. ..... 367/150

[58] Field of Search ..... 367/138, 150; 310/335; 181/176; 128/663.01; 73/642

[56] References Cited

U.S. PATENT DOCUMENTS 5,193,527 3/1993 Schäfer ..... 73/642

FOREIGN PATENT DOCUMENTS 2650144 1/1991 France .

*Primary Examiner*—Daniel T. Pihulic

*Attorney, Agent, or Firm*—Pollock, Vande Sande & Priddy

[57] ABSTRACT

The process comprises the steps of calculating, by varying the opening angle of a cluster, a first group of reference points of x, z coordinates in an incidence plane of the beam, so that the times taken by the ultrasounds to pass through the reference points and through the focal point are identical, then calculating a second group of reference points of y, z coordinates in a plane perpendicular to the incidence plane, defining two polynomials of degree 4 by polynomial interpolation by the method of least squares of the two previously calculated groups of points of the following form: $f(x)-ax^4+bx^3+cx^2+dx$ $g(y)=a'y^4+b'y^3+c'y^2+d'y$, determining the x, y and z coordinates of the points of the output surface by the relation $z=f(x)+g(y)$, and producing the output surface by means of the coordinates.

5 Claims, 4 Drawing Sheets

PROCESS FOR PRODUCING THE OUTPUT SURFACE OF A FOCUSED ULTRASONIC BEAM TRANSDUCER AND TRANSDUCER WITH AN OUTPUT SURFACE PRODUCED BY SAID PROCESS

FIELD OF THE INVENTION

The present invention relates to a process for producing the output surface of a focused ultrasonic beam transducer, and an ultrasonic transducer with an output surface produced by such process.

BACKGROUND OF THE INVENTION

Focused ultrasonic transducers are used for non-destructive ultrasonic inspection of component parts placed in an acoustic coupling medium.

Ultrasonic transducers of this type are known in the art.

For example, FR-A-2 650 144 shows a focused ultrasonic transducer which comprises a focusing acoustic lens and a planar piezoelectric pellet, the lens being planar-concave and placed against the pellet by its planar surface, its output surface being such that the incident ultrasonic beam emerging from the pellet is perpendicular to the plane of the latter and is refracted on the output surface in such manner that the refracted beam produced in the coupling medium, in turn refracted on the surface of the part to be inspected, converges exactly at the inspection point of the part.

In FR-A-2 650 144, the output surface of the lens is produced on the basis of calculations of two radii of curvature, but, when the surface is machined with the aid of such calculations, only a very rough approximation of the ideal Fermat surface (equiphase) is obtained, since the error increases with the distance from the reference point of the calculation of the circle and is maximal at the points which are the most remote from the reference points.

This results in more or less serious problems as to the quality of the inspection of the parts.

SUMMARY OF THE INVENTION

An object of the invention is to overcome these problems by providing a process which permits optimizing the production of such an output surface of a focused ultrasonic transducer and providing a surface which is as near as possible to an ideal Fermat surface.

The invention therefore provides a process for producing the output surface of a focused ultrasonic beam transducer, in particular for non-destructive ultrasonic inspection of a component part placed in an acoustic coupling medium, the process comprising the following steps:

(1) calculating, by varying the opening angle of the beam, a first group of reference points of x, z coordinates in an incidence plane of the beam, so that the times taken by the ultrasounds to pass through the reference points and through the focal point are identical, (2) calculating a second group of reference points of y, z coordinates in a plane perpendicular to the incidence plane, (3) defining two polynomials of degree 4 by a polynomial interpolation by the method of least squares of the two previously-calculated groups of points, of the following form:

$$f(x)=ax^4+bx^3+cx^2+dx$$

$$g(y)=a'y^4+b'y^3+c'y^2+d'y$$

(4) determining the x, y and z coordinates of the points of the output surface by the relation:

$$z=f(x)+g(y), \text{ and}$$

(5) producing the output surface by means of said coordinates.

Advantageously, the output surface is produced by machining it.

According to another aspect, the invention also provides an ultrasonic transducer with an output surface produced by the above-described process.

BRIEF DESCRIPTION OF THE DRAWINGS

A better understanding of the invention will be had from the following description which is given solely by way of example with reference to the accompanying drawings, in which.

DETAILED DESCRIPTION

Figure 1:
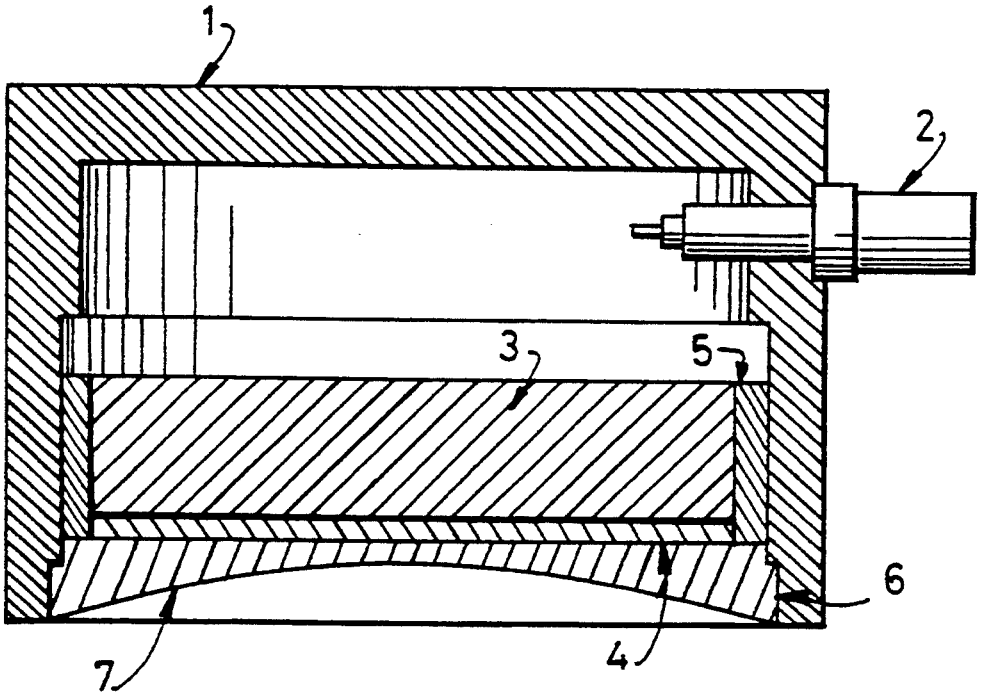
FIG. 1 is a schematic sectional view of a focused ultrasonic transducer.

As shown in FIG. 1, a focused ultrasonic transducer comprises a case 1 provided with connecting means 2 for connecting the transducer to any suitable means for activating and analyzing its output signals.

The transducer further comprises a damper 3 on which a piezoelectric pellet 4 is fixed.

A sheath 5, for example composed of Cellerond, is disposed around this damper and pellet.

A focusing acoustic lens 6 may be fixed, for example by adhesion, to the piezoelectric pellet. The output surface 7 of the lens delivers an ultrasonic beam and has a shape which is as near as possible to that of an equiphase surface, which is still called Fermat's surface.

A more detailed description of the structure and operation of such a focused ultrasonic transducer is given in the aforementioned FR-A-2 650 144 the disclosure of which is included in the present specification by reference.

However, it will be observed that these ultrasonic transducers are used for example for the non-destructive ultrasonic inspection of component parts placed in an acoustic coupling medium.

Such a transducer indeed produces acoustic waves in the part to be analyzed, and the analysis of the waves reflected and/or diffracted by one or more defects or faults in the part permits obtaining a diagnostic of the quality of the part, detecting the presence of defects and determining their dimension.

As mentioned before, the invention relates to a process for producing the output surface of the transducer in such manner as to obtain the best approximation of Fermat's surface and for improving the quality of the inspections.

Figure 2:
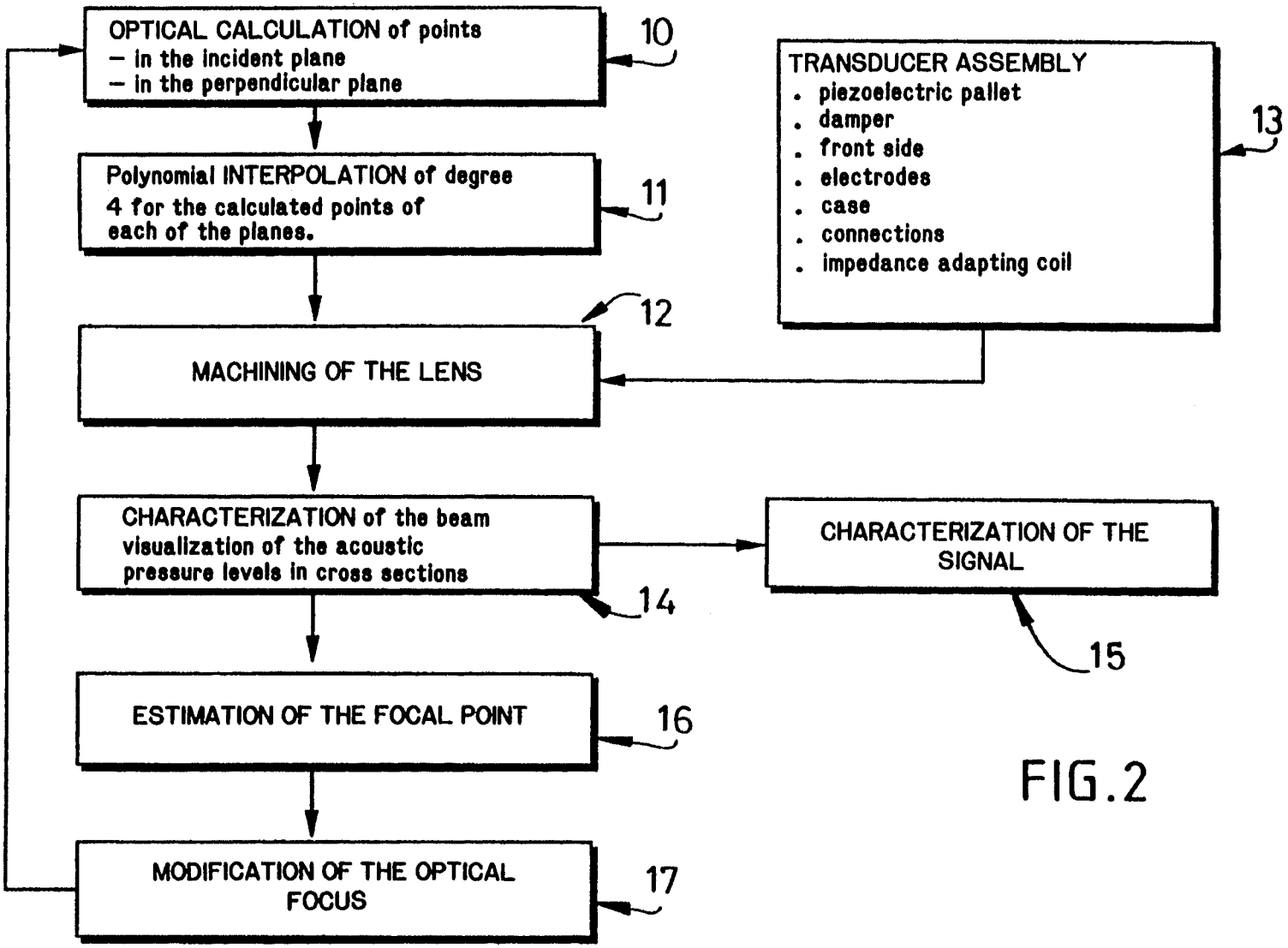
FIG. 2 is a flow chart illustrating the different steps of a process according to the invention.

The process comprises several steps, illustrated in FIG. 2.

The definition of the output surface of such a transducer takes into account a number of data, such as:

- the geometry of the part to be inspected (planar, concave or convex cylindrical),
- the depth of the inspection in the part,
- the height of the acoustic coupling medium (for example, water), and
- the desired dimensions of the beam.

The first step of the production process according to the invention, designated by 10 in FIG. 2, comprises calculating a first group of reference points of x, z coordinates in an incidence plane of the ultrasonic beam, and a second group of reference points of y, z coordinates in a plane perpendicular to the incidence plane, by varying the opening angle of the beam, in such manner that the times taken by the ultrasounds to pass through the reference points and through the focal point are identical.

As this calculation is conventional and does not present any particular problem, it will not be further described.

Once these groups of reference points have been calculated, the next step, designated as 11 in FIG. 2, comprises defining two polynomials of degree 4 by polynomial interpolation by the method of least squares of the two previously-calculated groups of points.

These polynomials have the following form:

in the incident plane:

$$f(x)=ax^4+bx^3+cx^2+dx$$

in the plane perpendicular to the incident plane:

$$g(y)=a'y^4+b'y^3+c'y^2+d'y$$

This interpolation method presents no particular difficulties and will not be described in more detail.

It is then possible to determine the different x, y and z coordinates of the points of the output surface by the relation:

$$z=f(x)+g(y),$$

and to produce the output surface, for example by machining, with the aid of these coordinates, as illustrated by the block 12 in FIG. 2.

This surface may be produced on the lens.

The lens, whose output surface has been machined in this way, is then used in the transducer assembly with the different elements mentioned in block 13 in FIG. 2, namely, a piezoelectric pellet, a damper, a case, electrodes, connections and an impedance adapting coil.

It will be clear that the Fermat surface may also be machined directly on the piezoelectric pellet.

Other conventional manufacturing methods, for example die pressing, may be used for putting the lens or the pellet in the correct shape.

The step designated 14 in FIG. 2 concerns characterizing the beam by the visualization of the acoustic pressure levels in cross-sections, which permits, at 15, characterization of the output signal of this transducer, at 16, estimation of the focal point and, at 17, possible modification of the optical focus by recalculating the Fermat surface and carrying out a new machining step which will still further improve the quality of the inspection. As these various operations are conventional, they will not be described in detail.

However, the focusing is optimized by the characterization of the transverse dimensions of the beam.

This characterization is, for example, in the coupling medium through a lens of the same type as the component part to be inspected and representing the curvature of the part. This lens is so designed that it reproduces the inspection conditions for the incident and refracted beams in the lens and that the refracted beam emerges in the perpendicular direction.

If necessary, the Fermat surface may be modified, with new calculations and new machining.

This final step personalizes the Fermat surface thus obtained.

The process according to the invention permits obtaining an improved approximation of the ideal Fermat surface by employing polynomial interpolation by the method of least squares of the groups of reference points, the surface obtained being defined as being the sum of the two polynomials obtained.

Figure 3:
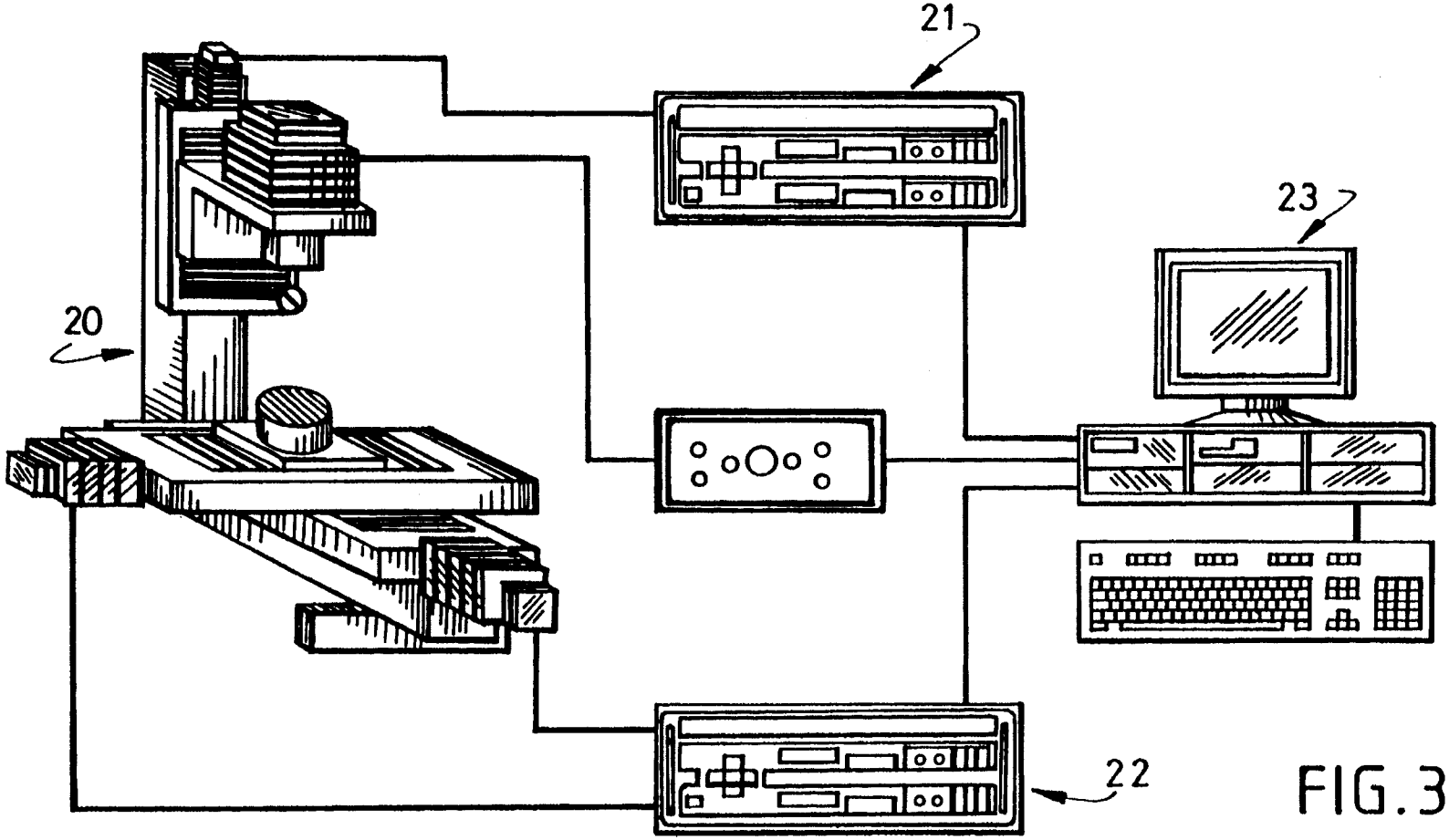
FIG. 3 is a block diagram showing the different means employed for carrying out a machining stage of a process according to the invention.
Figure 4:
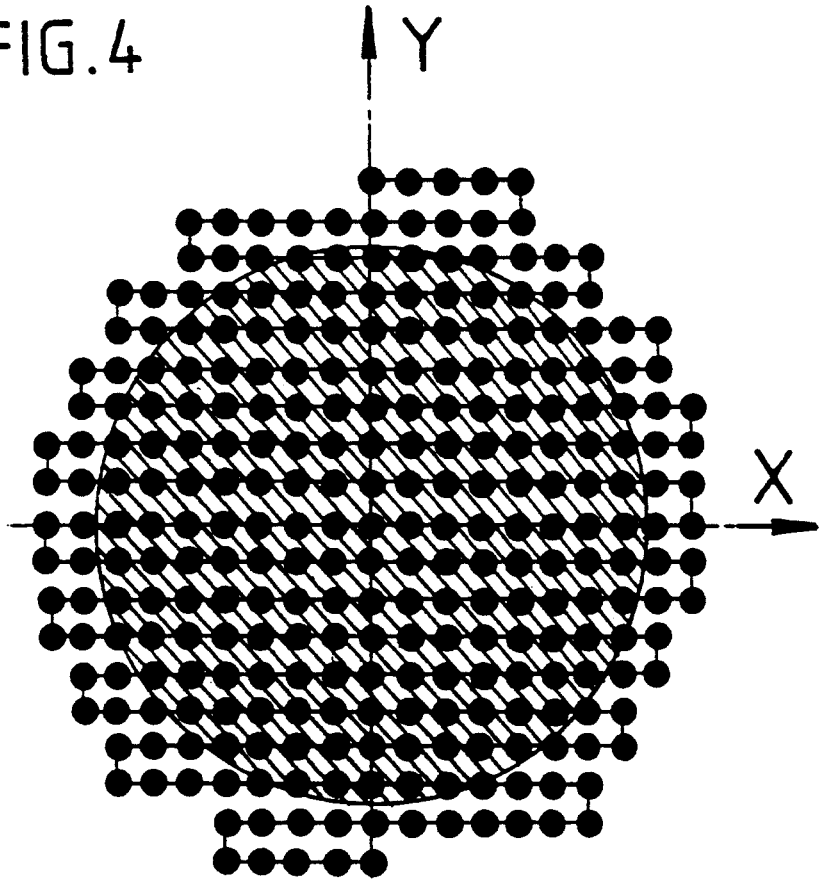
FIGS. 4 and 5 illustrate the machining stage of the process.
Figure 5:
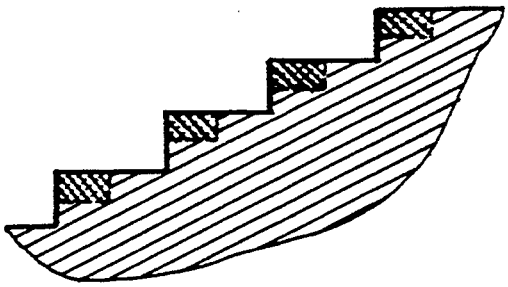

As can be seen in FIGS. 3, 4 and 5, the output surface of the transducer may be produced, for example, by machining the lens or the pellet, by means for example of a numerically controlled machine tool, or a special machine controlled by a microcomputer, such as a milling machine 20 having a table fed in perpendicular directions, the movements of the tool and of the table being controlled through indexing means 21 and 22, respectively, by a microcomputer 23 calculating the machining dimension step by step.

As illustrated in FIG. 4, the machining may be effected step by step on the X axis and with incrementation along the Y axis, the machining dimension z being calculated for each point from the aforementioned relations.

It will be clear that the machining may be carried out in two passes (FIG. 5), namely:

- a first pass, termed a rough machining, in which the step may be on the order of 1 mm, and
- a second pass, termed the finishing machining, in which the step may be on the order of 0.5 mm.

What is claimed is:

1. Process for producing an output surface of a focused ultrasonic beam transducer, said process comprising in combination the following steps:

(a) calculating, by varying an opening angle of said beam, a first group of reference points of x, z coordinates in an incidence plane of said beam, so that the times taken by supersounds to pass through said reference points and through a focal point are identical;

(b) calculating a second group of reference points of y, z coordinates in a plane perpendicular to said incidence plane;

(c) defining two polynomials of degree 4 by polynomial interpolation by the method of least squares of said two previously-calculated groups of reference points, in the following form:

$$f(x)-ax^4+bx^3+cx^2+dx$$

$$g(y)=a'y^4+b'y^3+c'y^2+d'y$$

(d) determining the x, y and z coordinates of the points of an output surface by the relation:

$$z=f(x)+g(y);\text{ and}$$

(e) producing said output surface by means of said coordinates.

2. Process according to claim 1, producing said output surface by machining said output surface.

3. Focused ultrasonic beam transducer, comprising an output surface which has been produced by a process comprising in combination the following steps:

(a) calculating, by varying an opening angle of said beam, a first group of reference points of x, z coordinates in an incidence plane of said beam, so that the times taken by ultrasounds to pass through said reference points and through a focal point are identical;

(b) calculating a second group of reference points of y, z coordinates in a plane perpendicular to said incidence plane;

(c) defining two polynomials of degree 4 by polynomial interpolation by the method of least squares of said two previously-calculated groups of reference points, in the following form:

$$f(x)-ax^4+bx^3+cx^2+dx$$

$$g(y)=a'y^4+b'y^3+c'y^2+d'y$$

(d) determining the x, y and z coordinates of the points of an output surface by the relation:

$$z=f(x)+g(y); \text{ and}$$

(e) producing said output surface with the aid of said coordinates.

4. Transducer according to claim 3, comprising a piezoelectric pellet, said output surface being produced on said pellet by shaping said pellet.

5. Transducer according to claim 3, comprising a piezoelectric pellet and a focusing lens fixed on said piezoelectric pellet, said output surface being formed on said lens by shaping said focusing lens.

* * * * *